US006950032B1

(12) United States Patent
Hewitt et al.

(10) Patent No.: US 6,950,032 B1
(45) Date of Patent: Sep. 27, 2005

(54) APPARATUS AND METHOD FOR PROTECTION AGAINST APPLIANCE LEAKING

(75) Inventors: John K. Hewitt, Murfreesboro, TN (US); Ronald Andrew Cina, Murfreesboro, TN (US); Ronald August Cina, Hixson, TN (US)

(73) Assignee: Dry Systems, Inc., Murfreesboro, TN (US)

( * ) Notice: Subject to any disclaimer, the term of this patent is extended or adjusted under 35 U.S.C. 154(b) by 195 days.

(21) Appl. No.: 10/027,225

(22) Filed: Dec. 26, 2001

Related U.S. Application Data

(63) Continuation-in-part of application No. 09/546,489, filed on Apr. 10, 2000, now abandoned.

(51) Int. Cl.[7] ..... G08B 21/00

(52) U.S. Cl. ..... 340/686.1; 340/686.1; 340/693.2; 340/616; 200/61.04; 137/312; 137/395; 73/304 R

(58) Field of Search ..... 340/605, 616, 340/693.1, 693.2, 686.1, 603, 604, 620; 200/61.04, 200/61.05, 61.06, 61.08; 137/312, 386, 392, 137/393, 395; 73/304 R, 290 R

(56) References Cited

U.S. PATENT DOCUMENTS

| | | | | |
|---|---|---|---|---|
| 2,432,367 A | | 12/1947 | Andersen | |
| 2,726,294 A | | 12/1955 | Kroening et al. | |
| 3,200,388 A | * | 8/1965 | Uhlig | 340/604 |
| 3,770,002 A | * | 11/1973 | Brown | 137/312 |
| 3,847,547 A | | 11/1974 | Delgendre et al. | |
| 3,872,419 A | | 3/1975 | Groves | |
| 4,163,449 A | | 8/1979 | Regal | |
| 4,418,712 A | | 12/1983 | Braley | |
| 4,489,603 A | | 12/1984 | Fukami et al. | |
| 4,591,838 A | * | 5/1986 | Jarvis et al. | 340/605 |
| 4,845,472 A | | 7/1989 | Gordon et al. | |
| 4,888,455 A | * | 12/1989 | Hanson | 200/61.04 |
| 5,188,143 A | | 2/1993 | Krebs | |
| 5,190,069 A | | 3/1993 | Richards | |
| 5,240,022 A | | 8/1993 | Franklin | |
| 5,334,973 A | | 8/1994 | Furr | |
| 5,357,241 A | * | 10/1994 | Welch, Jr. et al. | 340/605 |
| 5,844,492 A | | 12/1998 | Buffin, Sr. | |
| 5,877,689 A | | 3/1999 | D'Amico | |
| 5,918,617 A | * | 7/1999 | Garth | 137/312 |

* cited by examiner

*Primary Examiner*—Jeffrey Hofsass
*Assistant Examiner*—Daniel Previl
(74) *Attorney, Agent, or Firm*—I. C. Waddey, Jr.; Waddey & Patterson, PC

(57) ABSTRACT

A water protection system apparatus for detecting and stopping a flow of water which includes a power supply, a water ionization switch, and a controlled valve assembly. The water ionization switch selectively conducts electricity when exposed to water and includes an initially dry non-conductive crystallized compound. The compound ionizes when exposed to water to form an electrolyte which conducts electricity. This switch is connected to a controlled valve assembly to stop the flow of water in response to the detection of water by the switch. Other refinements include modifications to the switch housing and condition indicators for monitoring the system and signaling water detection and shutdown operations.

8 Claims, 3 Drawing Sheets

APPARATUS AND METHOD FOR PROTECTION AGAINST APPLIANCE LEAKING

This application claims benefit as a continuation in part of U.S. patent application Ser. No. 09/546,489 filed Apr. 10, 2000 now abandoned entitled "Apparatus and Method for Protection Against Appliance Leaking" which is hereby incorporated by reference.

Be it known that I, John K. Hewitt, a citizen of United States, residing at 2610 Chase Lane, Murfreesboro, Tenn. 37130; Ronald Andrew Cina, a citizen of the United States, residing at 2606 Chase Lane, Murfreesboro, Tenn. 37129; and Ronald August Cina, a citizen of the United States, residing at 1615 Lake Marina Drive, Hixson, Tenn. 37343 have invented a new and useful "Apparatus and Method for Protection Against Appliance Leaking."

BACKGROUND OF THE INVENTION

The present invention relates generally to plumbing systems or devices utilizing water connections. More particularly, this invention pertains to general appliances that utilize water connections that are subject to breakage. The invention has utility in applications such as washing machines, water heaters, ice makers, dishwashers and other appliances associated with water overflow or spillage. The application claimed herein is the only system using an ionizing water sensor. All other known or patented devices use systems that are more complex or expensive.

A basic understanding of chemical compositions and electrolytes is helpful in understanding the present invention. Water is an excellent solvent for many compounds. Some compounds dissolve in water as molecules while electrolytes dissociate and dissolve as charged species called ions. Some dissolved compound solutions conduct electricity better than others do, and can be rated on a scaling system. The scaling system includes strong electrolytes, weak electrolytes, and non-electrolytes. These Electrolytes are compounds which dissolve in water to produce solutions that conduct an electric current. A strong electrolyte conducts electricity very well. A weak electrolyte conducts electricity, but not very well. A non-electrolyte does not conduct electricity at all.

Strong electrolytes conduct electricity very well and ionize almost one hundred percent (100%). Most of the salts are in the strong electrolyte category. Examples of strong electrolytes include: HCl, HBr, HI, HNO3, HClO4, H2SO4, HClO3, LiOH, NaOH, KOH, RbOH, CsOH, Ca(OH)2, Sr(OH)2, and Ba(OH)2. There are three common ways in which strong electrolyte conductor can be classified. These are as follows (1) creating an electrolyte by dissolving salts in a solvent by breaking the salt up into its ions; (2) use an acid to give off H+ ions; and (3) use a base to give off OH ions to allow for a good flow of electricity through the solution.

Strong acids are also strong electrolytes. The hydroxides of Groups I and II are considered strong bases and are also strong electrolytes. In addition, most other ionic compounds are strong electrolytes. Generally, the halides and cyanides of "heavy metals" are weak electrolytes and most organic compounds are nonelectrolytes. Some exceptions to he organic compounds are organic acids and bases.

Weak electrolytes conduct electricity a little and are only partially ionized. Most of the acids and bases are in this category. Weak electrolytes include both weak acids and weak bases. A weak acid is much like a strong acid because it produces H+ ions, but the difference is that a weak acid only partially dissociates. Partially dissociating means that only a small percentage of the acid gives off the H+ ions. Weak bases release OH− ions instead of H+ ions.

Non-electrolytes do not conduct electricity and do not ionize. A good example of a non-electrolyte is water. Additional non-Electrolytes are substances that will dissolve in water, but do not produce any ions and therefore do not conduct electricity. For example, sugar will dissolve in water, but will not produce ions. Thus there is nothing to transfer electricity through the solution.

In general, the difference between strong and weak electrolytes is the extent to which the ionic compounds dissociate into ions when placed in water. The greater the amount of dissociation, the greater the electrical conductance of the solution. The strong electrolytes are usually considered to be one hundred percent (100%) dissociated, especially in dilute solutions, and weak electrolytes are usually dissociated less than ten percent (<10%).

This basic chemical information is used in the present invention in combination with a water system. The large majority of commercially feasible water sensors are of the electrical capacitance style detection devices. The devices continuously supply a known low voltage to a pair of electrodes and a return voltage is transmitted back. The return voltage is measured to see if a closed circuit has occurred representing the presence of water. This closed circuit then energizes a horn, light, shut off valve, or a combination of the above. These devices utilize low voltages as a safety feature and thus, these devices can be fooled by varying trace levels of elements in the water, such as calcium and iron. In addition, main power supply fluctuations and electrical noise will also affect the reliability of these devices.

Several United States Patents have been directed towards water detection systems. These patents include U.S. Pat. No. 2,432,367, issued to Anderson on Sep. 23, 1943; U.S. Pat. No. 2,726,294, issued to Kroening, et al on Jan. 30, 1951; U.S. Pat. No. 3,770,002, issued to Brown on Nov. 6, 1973; U.S. Pat. No. 3,847,547, issued to Delgendre, et al on Nov. 12, 1974; U.S. Pat. No. 3,872,419, issued to Groves, et al on Mar. 18, 1975; U.S. Pat. No. 4,163,449, issued to Regal on Aug. 7, 1979; U.S. Pat. No. 4,418,712 issued to Braley on Dec. 6, 1983; U.S. Pat. No. 4,489,603, issued to Fukami, et al on Dec. 25, 1984; U.S. Pat. No. 4,845,472, issued to Gordon on Jul. 4, 1989; U.S. Pat. No. 5,188,143 issued to Krebs on Feb. 23, 1993; U.S. Pat. No. 5,190,069 issued to Richards on Mar. 2, 1993; U.S. Pat. No. 5,240,022 issued to Franklin on Aug. 31, 1993; U.S. Pat. No. 5,334,973, issued to Furr on Aug. 2, 1994; U.S. Pat. No. 5,844,492 issued to Bufflin, Sr. on Dec. 1, 1998; and U.S. Pat. No. 5,877,689 issued to D'Amico on Mar. 2, 1999. The following is a brief discussion of the most relevant of these patents.

U.S. Pat. No. 2,432,367 issued to Anderson on Dec. 9, 1947 discloses a leak detector. This specification discloses the use of a water absorbent material which expands to close the contacts of an electrical circuit for generating a water detection signal. In this specification, it is noted that the electrical contacts should be maintained separately from the absorbent material and the fluid that is to be detected.

U.S. Pat. No. 3,847,547 issued to Delgendre et al. on Nov. 12, 1974, discloses a PROCESS AND APPARATUS FOR DETECTING OF THE PRESENCE OF A LIQUID. This specification describes the use of a chemical reaction, such as a pyrotechnical composition with the absorption of water for closing an electrical circuit. Specifically, the invention teaches the production of heat to generate an electrically conducting deposit in the zone situated between the two electrodes for closing an electrical circuit. The invention also teaches the melting of fusible conducting wire in order to open an electrical circuit. These processes are activated by a chemical reaction when water is introduced into the sensor.

U.S. Pat. No. 4,418,712 issued to Braley on Dec. 6, 1983 discloses an overflow control system for use with appliances such as washing machines. The device has a sensor mechanism that senses any spilled water beneath the machine. Upon water being sensed, electrical circuitry is activated that sounds an alarm and also shuts off the washing machine so that the machine will not continue to pump water through its exit pipe and into the drain stand. This device is designed to avoid problems associated with overflows because of clogging of the drain lines but does not address the need to shut off water coming into the machine.

U.S. Pat. No. 4,489,603 issued to Fukami et al. on Dec. 25, 1984 discloses a moisture sensitive element. In column 1, lines 39–45, this patent specification describes the use of prior art humidity detection systems and references the "ionic conduction through moisture absorption" for humidity sensors. However, as noted by this description of the prior art systems, the prior art units are directed towards humidistats and not switches.

U.S. Pat. No. 5,190,069 issued to Richards on Mar. 2, 1993 discloses a leak detection apparatus for monitoring leakage for household water systems. The system includes a pair of spaced wires imbedded in an insulating tape. The tape can be wrapped about water supply lines and if there is a leakage, the spaced wires will be connected and activate a servo to turn off a supply valve and/or sound an alarm.

U.S. Pat. No. 5,240,022 issued to Franklin on Aug. 31, 1993 discloses an automatic shut off valve system for installation in the water supply line of a hot water heater. The devise includes a sensor to detect leakage electrically by sensing moisture beneath the hot water heater and in response to the sensing of moisture, the device uses a valve system for shutting off the supply line to the hot water heater. The device of this patent is best illustrated in FIG. 2, showing a leak detection module 17 which activates the shut off valve 1 which is activated in response to the module 17 sensing moisture beneath the hot water heater. The cut off valve 1 is inserted in the supply pipe via the pipe fittings 2 and 3 as can be seen in FIG. 1.

U.S. Pat. No. 5,334,973 issued to Furr on Aug. 2, 1994 discloses a leak detection and a shut-off apparatus. This patent describes a sensor 127 which utilizes a blotter or non-conductive material that becomes conductive when it absorbs moisture. The blotter is contained within a copper skin such that it allows a capacitance current to flow when water is detected.

U.S. Pat. No. 5,877,689 issued to D'Amico on Mar. 2, 1999. The D'Amico patent discloses a system quite similar to that of the Franklin patent. There is shown a water appliance 12 having a supply pipe 14 which allows water to be supplied to the appliance. In this particular case, the appliance is gas powered and has a gas supply conduit 16 for transmitting gas from the gas source to the machine. Situated below the water appliance is a water sensor 34. When the water sensor 34 detects water in the pan beneath the appliance, it is activated to both shut off the water supply to the appliance and shut off the gas supply to the appliance so that the appliance will not burn out once the water is drained from the appliance.

These systems fail to disclose adequate systems for efficient, low-cost water detection systems for household appliances and other water utilizing systems. Therefore, because of the inadequate systems presently used in the prior art an improved water detection system is required. The present system is designed to provide a low-cost, basic, reliable, protection system that is not susceptible to voltage fluctuations or electrical noise and provides an affordable alternative for the consumer.

SUMMARY OF THE INVENTION

The present invention is directed towards a water protection system apparatus for detecting and stopping a flow of water which includes a low voltage (9v D.C.) power supply, a water ionization switch, and a controlled valve assembly. The water ionization switch selectively conducts electricity when exposed to water and includes an initially dry non-conductive crystallized compound. The compound ionizes when exposed to water to form an electrolyte which conducts electricity. This switch is connected to a controlled valve assembly to stop the flow of water in response to the detection of water by the switch. Other refinements include modifications to the switch housing and condition indicators for monitoring the system and signaling water detection and shutdown operations.

DESCRIPTION OF THE PREFERRED EMBODIMENTS

Figure 1:
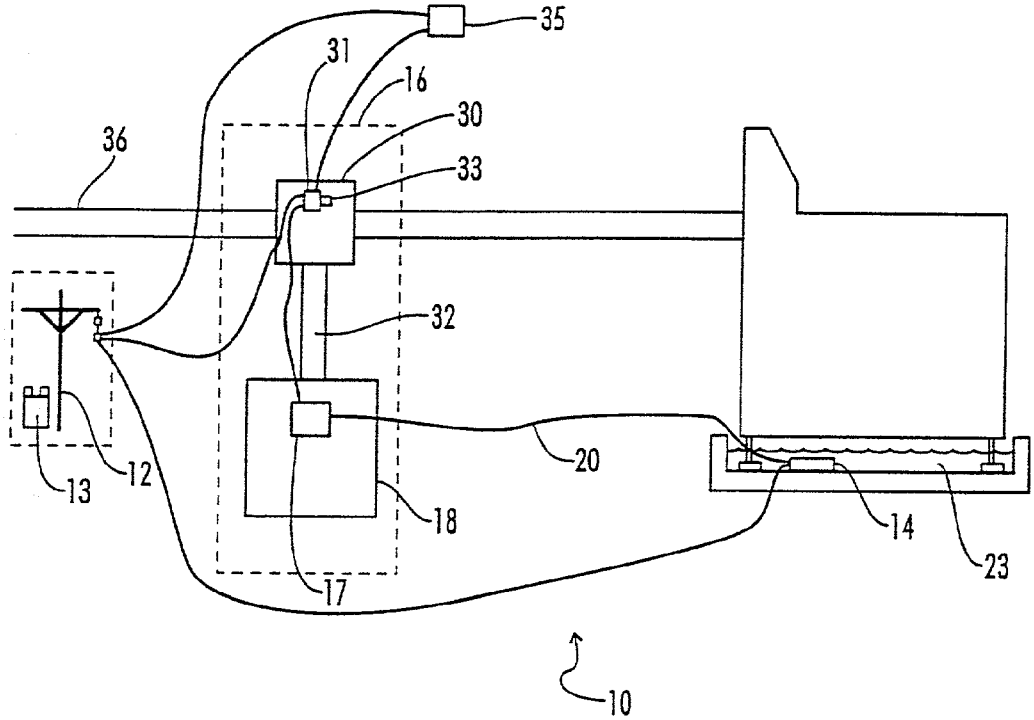
FIG. 1 is a schematic diagram of a water leakage protection apparatus applied to an appliance that uses water.

In accordance with an exemplary embodiment of the present invention as shown in FIG. 1, the water leakage protection apparatus 10 includes as major components a low voltage power supply (9v D.C.) 12, an ionization type water sensor 14 connected to the power supply 12; and a controlled valve assembly 16 connected to both the power supply 12 and the ionization type water sensor 14. The water leakage protection apparatus 10 can be applied to a single appliance that uses water or can be supplied for multiple applications to protect an entire plumbing system.

The power supply 12 provides a nine-volt DC electrical supply signal for the apparatus 10. The voltage level of the power supply 12 and the associated electrical signal should be kept as low as possible to reduce any potential shock hazards and the preferred embodiment utilizes a voltage of less than twelve volts DC. This low voltage allows for the safe operation of the water leakage protection apparatus 10 in high humidity or wet environments where high voltage power systems could prove to be harmful or fatal due to electrical shock or creepage. The apparatus 10 may also utilize a back up battery 13 for continued protection during power outages or brown outs.

Figure 2:
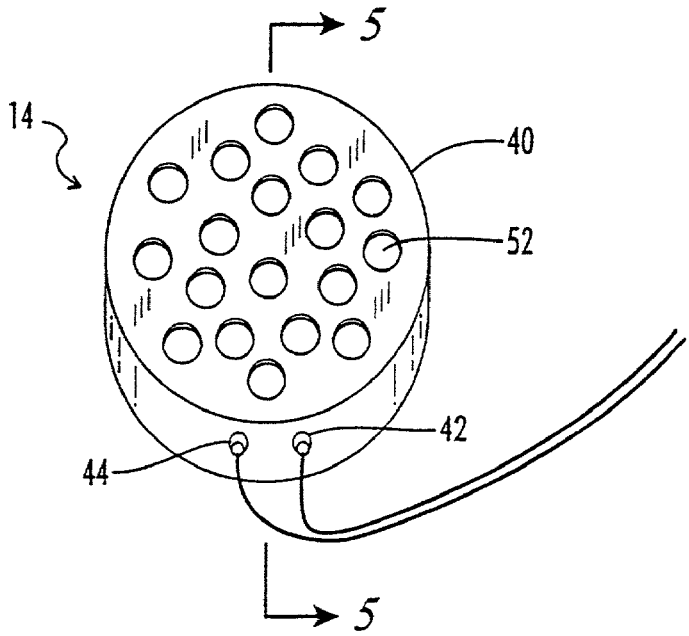
FIG. 2 is a top isometric view of the water ionization switch of the present invention including a container openings that allow for water penetration of the interior of the container.
Figure 3:
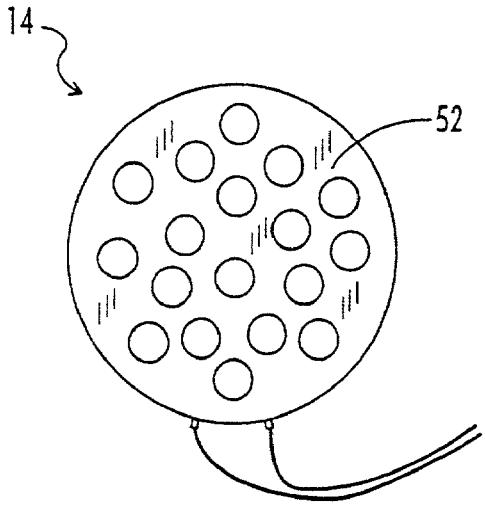
FIG. 3 is a top view of the water ionization switch of the present invention showing water penetration openings that allow for water penetration of the interior of the container.
Figure 4:
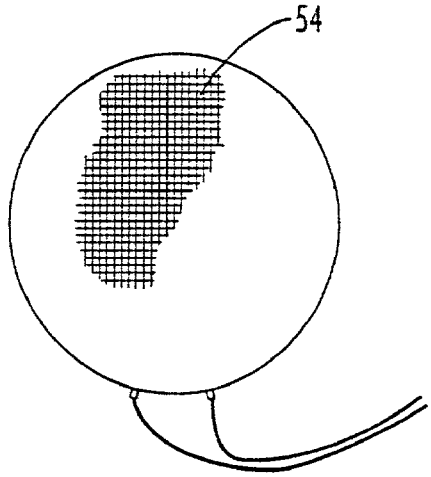
FIG. 4 is a top view of an alternative embodiment of the water ionization switch of the present invention showing a water penetration mesh that allows for water penetration of the interior of the container.

The water ionization switch 14 is connected to the power supply 12 and selectively conducts the electrical signal when exposed to water 23. As shown in FIGS. 2 through 4, the ionization switch 14 consists of a container 40, two metallic electrodes 42, 44 and a dry non-conductive electrolyte crystallized compound 46.

In the preferred embodiment, the container 40 is a two-inch diameter housing manufactured from a non-conductive material. The shape of the container 40 may be of any configuration including round, square, triangular, ovoid, spherical or any other shape suitable to the application. As shown in FIGS. 2 through 5, the top cover 48 and bottom cover 50 contain openings 52 that allow for water penetration of the interior of the container 40. These openings 52 may be formed by utilizing multiple holes in the container 40, or the openings 52 could be made by using a fine nylon or poly-vinyl-chloride mesh 54 as illustrated in FIG. 4 to allow for water entry.

Also shown in FIGS. 1 through 5 are the mounting of the two electrodes 42 and 44 in the container 40. These electrodes 42 and 44 are mounted through the side of the housing and are spaced sufficiently apart so as not to make direct electrical contact between the electrodes 42 and 44.

Figure 5:
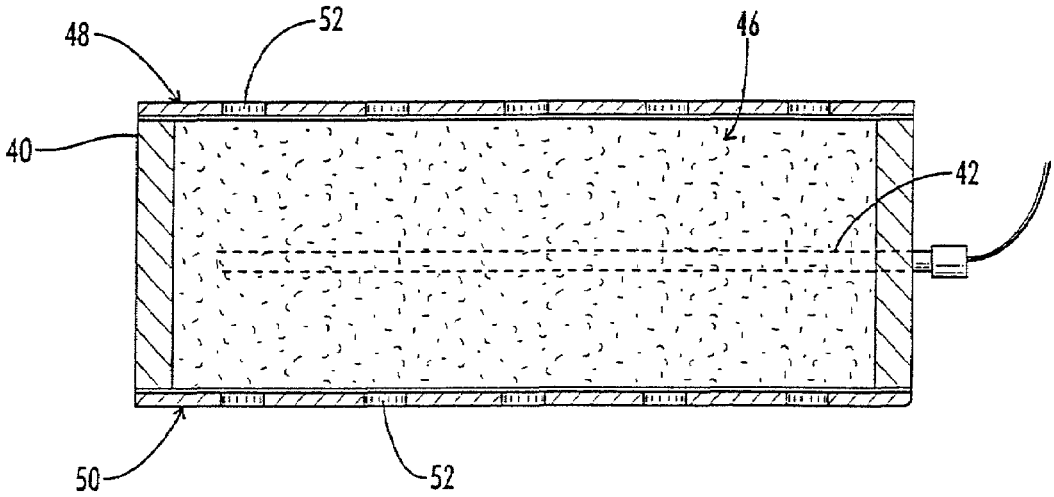
FIG. 5 is a cutaway view of the water ionization switch of FIG. 2 along line A—A showing a container with openings to allow water penetration, an electrode, and a dry non-conductive electrolyte crystallized compound held within the container.

The interior of the container 40 is filled with a dry crystallized non-conductive electrolyte element 46 as demonstrated in FIG. 5. When water 23 enters the container 40 through the openings 52, the water 23 comes in contact with the crystallized dry element 46. The water 23 then mixes with the dry crystallized electrolyte element 46 and a chemical change, also referred to as an ionization, takes place. This ionization forms an aqueous solution which creates a conductive chemical bridge uniting the two separating electrodes 42 and 44. In the preferred embodiment, a moisture level of approximately 40% of the mass of the element 46 is required to form the conductive electrolyte. Hence, the water being absorbed into the element 46 forms a conductive path and the chemical switch has been closed.

The electrolyte compound 46 should be non-conductive while in its dry state. However, when water is combined with the dry electrolyte compound, the electrolyte should produce ions which move through the aqueous solution and allow for the electric flow of current through the solution. While water is a poor conductor of electricity, water combined with an electrolyte provides for a good conducting medium. A good example of an electrolyte is the chemical compound of sodium chloride (NaCl), commonly referred to as table salt, which is used in the preferred embodiment of the present invention. Other solutions of strong electrolytes that are good conductors of electricity are: HCl, and NaOH.

The use of table salt as an electrolyte compound allows for a sensor that is not dangerous to the environment, is safe around children and pets, and is inexpensive and readily available. The use of sodium chloride also allows for a stable dry composition which allows for the creation of ions and the conductivity of electricity without producing any significant quantity of gasses, acids, or other negative effects. One should remember that large amounts of electricity combined with large quantities of electrolyte, and the particular choices of electrolytes, may produce dangerous quantities or concentrations of gasses, acids, or other secondary effects. Thus, if large switches of this nature are to be used, then the resulting chemical reaction components should be accounted for. These factors are not a problem for the size of the switch and the electrical power used in the preferred embodiment of the present invention. In addition, the availability and non-dangerous aspects of table salt, combined with the stable nature and safe reactions of sodium chloride in the size of switch used in the present application, make sodium chloride the preferred electrolyte compound.

Many electrolyte solutions taught in the prior art use fibers or cellulose material as a dielectric material to carry the electrolyte which results in a significant resistance between the electrodes during both conducting and non-conducting time periods. This leads to a potential drop between the electrodes due to the high resistance and an inability to conduct reasonable operating currents at low voltage levels to eliminate the requirement for weak sensor signals. Thus, prior art designs have consistently used high voltage levels to force current through the electrolyte/dielectric material or have sensed the change in capacitance of the sensor. The present invention overcomes this disadvantage as shown in FIG. 5 by using a container 40 to directly contain the sodium chloride type of electrolyte 46 without the requirement for the dielectric material. Thus, the present invention uses an electrolyte 46 that is constrained only by the container 40 and does not require a holding or dielectric material. This allows for the container 40 to be filled with an appropriate amount of the crystalline electrolyte 46 such that when the remainder of the volume of the interior of the container 40 is filled with water, a conducting aqueous solution will be formed between the electrodes 42 and 44. In this manner, the amount of electrolyte 46 is proportionally related to the volume of the interior of the container 40. This provides an improved sensor 14 with low voltage operating capability.

The first electrode 42 of the sensor 14 is connected to the controlled valve assembly 16 by a cable 20. The second electrode 44 is connected to the power supply 12. Thus, when the chemical switch closes, power is transferred through the switch to control the controlled valve assembly 16. These electrodes 42, 44 are constructed from standard electrode materials as is well known in the prior art.

The controlled valve assembly 16 is connected to the power supply 12 and the ionization type water sensor 14. The controlled valve assembly 16 includes an electric relay 17 connected to a motor 18 which controls a valve 30. The relay 17 controls the power flow to the electric motor 18. The electric motor 18 is connected by a shaft 32 to the valve 30 for controlling the position of the water valve 30. Once the motor 18 has moved the valve 30 to a closed position, a closed position switch 31 will be activated to disengaged the power to the motor 18. In this manner, the assembly 16 has shut off the water supply by closing the valve 30 and will remain inoperative until serviced and reset. Thus, by energizing the valve control relay 17, the system 10 controls the valve 30 and shuts off the water supply line 36.

The water supply valve 30 used on the stop leak system 10 can include an electric motor with a gear type actuated ball valve, an electric motor with type actuated sleeve valve, or an electric solenoid actuated piston valve. The preferred embodiment utilizes a ball valve with an actuator assembly.

A system condition indicator 35 may also be included with the system 10. As an example of the preferred system indicator 35, FIG. 1 shows an indicator lamp 35 attached to the motor position switch 31 to indicate when the water has been turned off by the system. The system could also be attached to the ionization switch to indicate the presence of water. Other types of indicators may include sound alarms, telephone messages, computer communication, or an interconnection with a home alarms system and its various indication methods.

The water leakage protection system 10 normally rests in a waiting mode and activates only in the detection of water 23. When water 23 comes into contact with the sensor 14, an ion exchange takes place within the crystallized compound 46, and it becomes an electrolyte creating a closed circuit between the two separated electrodes 42 and 44. Thus, the chemical switch 14 is closed allowing for electricity to flow between the electrodes 42 and 44. This allows for power to flow from the power supply 12 which causes the relay 17 to close. The closing of the relay 17 energizes the valve motor 18 and closes the valve 30. When the valve 30 closes it opens a micro switch 31 disarming the power to the valve 30. The incoming water flow supply 36 is stopped and cannot restart without service attention. After the water leak has been corrected the stop leak valve 30 is reopened by pressing a reset button 33. The water can now flow to the individual appliance or through the entire plumbing system.

Thus, although there have been described particular embodiments of the present invention of a new and useful Protection Against Appliance Leaking, it is not intended that such references be construed as limitations upon the scope of this invention except as set forth in the following claims.

What is claimed is:

1. A water protection system apparatus for detecting and stopping a flow of water, comprising:

a power supply for generating a direct current electrical signal;

a water ionization switch connected to the power supply, said water ionization switch including a container, wherein the water ionization switch selectively conducts the direct current electrical signal when exposed to water, the water ionization switch including an initially dry non-conductive crystallized compound constrained only by said container, wherein the compound ionizes to form an electrolyte when combined with water; and a controlled valve assembly connected to the power supply and the ionization switch, wherein the valve assembly stops the flow of water in response to a change in the direct current electrical signal.

2. The apparatus of claim 1, wherein the electrical signal utilizes a voltage of less than 12 volts as a safety feature for reducing electrical shock hazards.

3. The apparatus of claim 1, the power supply including a main power supply and a backup battery which allows operation of the system during periods of inadequate power from the main power supply.

4. The apparatus of claim 1, said water ionization switch including:

a container with openings to allow for water entry;

a first and second electrodes located within the container and separated by the compound.

5. The apparatus of claim 1, said controlled valve assembly including:

an electric relay connected to the sensor;

a valve actuator connected to the relay;

a reset switch connected between the sensor and the relay.

6. The apparatus of claim 5, said controlled valve assembly further including a reset button connected to said reset switch.

7. The apparatus of claim 1, further comprising:

a condition indicator operatively connected to said ionization switch and said power supply for indicating the operation of said valve assembly.

8. The apparatus of claim 7, wherein said condition indicator includes a light source.

* * * * *